US005907237A

United States Patent [19]

Sekimoto

[11] Patent Number: 5,907,237

[45] Date of Patent: May 25, 1999

[54] VOLTAGE DROPPING CIRCUIT AND INTEGRATED CIRCUIT

[75] Inventor: Yasuhiko Sekimoto, Hamamatsu, Japan

[73] Assignee: Yamaha Corporation, Hamamatsu, Japan

[21] Appl. No.: 08/977,032

[22] Filed: Nov. 25, 1997

[30] Foreign Application Priority Data

Nov. 27, 1996 [JP] Japan ..... 8-316753

[51] Int. Cl.[6] ..... G05F 2/40

[52] U.S. Cl. ..... 323/282; 323/283; 323/284

[58] Field of Search ..... 323/282, 284, 323/285

[56] References Cited

U.S. PATENT DOCUMENTS

| | | | |
|---|---|---|---|
| 5,089,768 | 2/1992 | Sato | 323/282 |
| 5,497,119 | 3/1996 | Tedrow et al. | 323/282 |
| 5,519,599 | 5/1996 | Shinada et al. | 363/21 |
| 5,552,697 | 9/1996 | Chan | 323/282 |
| 5,563,501 | 10/1996 | Chan | 323/282 |
| 5,671,149 | 9/1997 | Brown | 323/282 |
| 5,774,734 | 6/1998 | Kikinis et al. | 323/282 |

FOREIGN PATENT DOCUMENTS

| | | | |
|---|---|---|---|
| 5-235282 | 9/1993 | Japan | H01L 27/04 |

*Primary Examiner*—Peter S. Wong
*Assistant Examiner*—Bao Q. Vu
*Attorney, Agent, or Firm*—Graham & James LLP

[57] ABSTRACT

A voltage dropping circuit is formed within an integrated circuit having at least one internal circuit, for dropping an external power supply voltage to generate a dropped voltage, and supplying the dropped voltage to the at least one internal circuit. A voltage divider divides the dropped voltage. A comparator compares the divided voltage with a reference voltage, and generates a control voltage according to a result of the comparison. A voltage generator generates the dropped voltage in response to the control voltage. A setting block sets a ratio of the divided voltage to the dropped voltage.

14 Claims, 11 Drawing Sheets

4'
REGISTER
ctrset1
ctrset2
ctrsetn
3
3-n
INTERNAL CIRCUIT
3-2
INTERNAL CIRCUIT
3-1
INTERNAL CIRCUIT
Vcc
2
1
Vref=2.5V
R1(=8K)
M1
M2
M3
R2(=25K)
R3(=5K)
R4(=5K)
R5(=5K)

VOLTAGE DROPPING CIRCUIT AND INTEGRATED CIRCUIT

BACKGROUND OF THE INVENTION

1. Field of the Invention

This invention relates to a voltage dropping circuit which is suitable for supplying electric power to an internal circuit formed by a submicron fabrication technique, and an integrated circuit using the voltage dropping circuit.

2. Prior Art

With the recent increase in density and operating speed of the integrated circuit, a so-called submicron fabrication technique has come to be more widely employed. According to the submicron fabrication technique, even more minuscule patterns are formed on a wafer than ones formed by conventional LSI fabrication techniques, so that the maximum permitted voltage of an oxide ($SiO_2$) layer decreases. This limits the power supply voltage of an LSI fabricated by the submicron fabrication technique normally to a voltage of 3.3 volts. On the other hand, many LSI products employ a power supply voltage of 5 volts. To cope with this discrepancy, an LSI has been proposed, which is comprised of an I/O portion where an oxide layer with an increased thickness is used, and an internal circuit where an oxide layer with a reduced thickness employed by the submicron fabrication technique is used.

In the proposed LSI, the I/O portion operates on a power supply voltage of 5 volts, while the internal circuit on a power supply voltage of 3.3 volts, which means that two power supply systems are required. As a solution to this problem, the proposed LSI employs a voltage dropping circuit arranged therein, which drops a power supply voltage of 5 volts from an external power supply to a voltage suitable for the submicron internal circuit.

Now, the conventional voltage dropping circuit will be described with reference to FIG. 1. As shown in the figure, an operational amplifier 1 has an output terminal thereof connected to the gate of an FET (field effect transistor) 2 formed by a PMOS (p-channel MOS) transistor. The FET 2 has a source thereof supplied with a power supply voltage of 5 volts, and a drain thereof connected to an internal circuit 3. This circuit configuration enables the FET 2 to function as a driver for supplying electric power to the internal circuit 3, in which the drain voltage VDL of the FET 2 is used as the power supply voltage of the internal circuit 3.

Further, the drain voltage VDL of the FET 2 is divided by a voltage divider formed by a resistance 1 and a resistance 2, and the divided voltage is fed back to a positive input terminal of the operational amplifier 1. On the other hand, the operational amplifier 1 has a negative input terminal thereof supplied with a reference voltage Vref. Therefore, when the voltage applied to the positive input terminal exceeds the reference voltage Vref, the output voltage of the operational amplifier 1 rises to turn the FET 2 off, which decreases the drain voltage VDL of the FET 2. When the voltage at the positive input terminal of the operational amplifier 1 becomes lower than the reference voltage Vref, the output voltage of the operational amplifier 1 decreases to turn the FET 2 on, which increases the drain voltage VDL of the FET 2. Thus, the voltage dropping circuit is constituted as a negative feedback amplifier comprised of the operational amplifier 1 and the FET 2 connected in series, whereby the drain voltage VDL is supplied as a stable voltage to the internal circuit. In the illustrated example, by setting the resistance R1 to a value of 8 K Ω, the resistance R2 to a value of 25 K Ω, and the reference voltage Vref to a value of 2.5 volts, a drain voltage VDL of 3.3 volts can be obtained.

In the conventional voltage dropping circuit, the drivability of the p-channel driver formed by the FET 2 and the dropped voltage (drain voltage VDL) depend on a variation in the load on the internal circuit 3 and an operation margin of the same. Assuming that the allowable lower limit voltage of the operation margin is 3 volts under the worst operating conditions (of operation of transistors, including the environmental temperature), for instance, the dropped voltage VDL has to be maintained at 3 volts even if the load on the internal circuit 3 varies. If a margin of 0.3 volts is allowed for the required power supply voltage, the dropped voltage VDL is set to 3.3 volts. Then, under the best conditions (the best conditions of operation of transistors, including the environmental temperature, and the worst conditions of the external power supply voltage), normal operation of the internal circuit has to be ensured even if the load on the internal circuit 3 varies. In short, the drivability of the FET 2 (p-channel driver) is determined under these conditions.

Now, provided that a change in the gate voltage which occurs when a load current flowing through the internal circuit 3 has changed from a value $I_B$ to a value $I_L$ is represented by ΔVi, and a change in the drain voltage on the same occasion by ΔVo, the following equations (1) and (2) hold:

$$\Delta Vi = [Cc/(Cg + Cc)] \times \Delta Vo \quad (1)$$

$$\Delta Vi = \sqrt{I_L/K} - \sqrt{I_B/K} \quad (2)$$

From the equations (1) and (2), the following equation can be obtained:

$$\Delta Vo = [(Cc + Cox \times L \times W)/Cc] \times \sqrt{I_L/(W \times K')} \times \left(\sqrt{I_L} - \sqrt{I_B}\right) \quad (3)$$

where Cc represents a Miller capacitance, Cg a gate capacitance of the FET, W a total width of the FET, and L a length of the same.

Now, let it be assumed that Cc=200 PF, Cox=2.0 F/$\mu m^2$, L=0.6 $\mu$m, and K'=10 $\mu A/V^2$, and it is required to limit the change ΔVo to 0.3 volts in cases where the variation in the load on the internal circuit 3 is in a range of 10 mA to 80 mA under the worst conditions and in a range of 10 mA to 100 mA under the best conditions. If these conditions are applied to the equation (3), a conforming FET has to fulfill W>31600 $\mu$m under the worst conditions, and W>55400 $\mu$m under the best conditions.

It will be noted from the above description that to ensure that the dropped voltage VDL obtained under the worst conditions can be obtained under the best conditions, it is required to increase the area of the FET 2. On the other hand, the peak current flowing through the internal circuit 3 under the best conditions tends to become larger than that under the worst conditions. Therefore, even where there is no problem in increasing the area, if settings are made so as to ensure the supply of the dropped voltage VDL under the worst conditions to the voltage dropping circuit even under the best conditions, a larger consumption current flows.

SUMMARY OF THE INVENTION

It is an object of the invention to reduce the area of a chip of an FET of the voltage dropping circuit and the consumption current of the same while ensuring normal operation of the internal circuit.

To attain the above object, according to a first aspect of the invention, there is provided a voltage dropping circuit that is formed within an integrated circuit having at least one internal circuit, for dropping an external power supply voltage to generate a dropped voltage, and supplying the dropped voltage to the at least one internal circuit.

The voltage dropping circuit according to the first aspect of the invention is characterized by comprising a voltage divider that divides the dropped voltage to obtain a divided voltage, a comparator that compares the divided voltage with a reference voltage, and generates a control voltage according to a result of the comparison, a voltage generator that generates the dropped voltage in response to the control voltage, and a setting block that sets a ratio of the divided voltage to the dropped voltage.

In one preferable form, the voltage divider comprises a plurality of resistances for dividing the dropped voltage, the setting block including at least one bypass transistor arranged in parallel with at least one of the resistances corresponding thereto, the at least one bypass transistor each having a gate, at least one fuse each having one end thereof connected to the gate of a corresponding one of the at least one bypass transistor, and another end thereof grounded, at least one external voltage input terminal each connected to the one end of a corresponding one of the at least one fuse, and at least one pull-up transistor for pulling up the gate of the corresponding one of the at least one bypass transistor.

In another preferable form, the voltage divider comprises a plurality of resistances for dividing the dropped voltage, the setting block including at least one bypass transistor arranged in parallel with at least one of the resistances corresponding thereto, the at least one bypass transistor each having a gate, at least one latch circuit each having an output terminal thereof connected to the gate of the corresponding one of the bypass transistor, the at least one latch circuit each having an input terminal, at least one fuse each having one end thereof connected to the input terminal of a corresponding one of the at least one latch circuit, and another end thereof grounded, at least one external voltage input terminal each connected to the one end of a corresponding one of the at least one fuse, at least one pull-up transistor for pulling up the input terminal of the corresponding one of the at least one latch circuit, the at least one pull-up transistor each having a gate, and at least one control input terminal each connected to the gate of the corresponding one of the at least one pull-up transistor.

In still another preferable form, the voltage divider comprises a plurality of resistances for dividing the dropped voltage, the setting block including at least one nonvolatile bypass transistor arranged in parallel with at least one of the resistances corresponding thereto, the at least one bypass transistor each having a gate and a source, at least one pull-up transistor for pulling up the gate of a corresponding one of the at least one nonvolatile bypass transistor, at least one first external voltage input terminal each connected to the gate of the corresponding one of the at least one nonvolatile bypass transistor, and at least one second external voltage input terminal each connected to the source of the corresponding one of the at least one nonvolatile bypass transistor.

In further preferable form, the voltage divider comprises a plurality of resistances for dividing the dropped voltage, the setting block including at least one bypass transistor arranged in parallel with at least one of the resistances corresponding thereto, the at least one bypass transistor each having a gate, and an internal register block provided within the internal circuit and having a plurality of registers each connected to the gate of a corresponding one of the at least one bypass transistor, the ratio of the divided voltage to the dropped voltage being set by controlling the internal register block.

More preferably, the integrated circuit comprises a plurality of internal circuits, the voltage dropping circuit being provided for each of the internal circuits.

To attain the above object, according to a second aspect of the invention, there is provided a voltage dropping circuit that is formed within an integrated circuit having at least one internal circuit, for dropping an external power supply voltage to generate a dropped voltage, and supplying the dropped voltage to the at least one internal circuit.

The voltage dropping circuit is characterized by comprising a voltage divider that divides the external power supply voltage to obtain a divided voltage, a comparator that compares the divided voltage with the dropped voltage, and generates a control voltage according to a result of the comparison, a voltage generator that generates the dropped voltage in response to the control voltage, and a setting block that sets a ratio of the divided voltage to the dropped voltage.

In one preferable form, the voltage divider comprises a plurality of resistances for dividing the external power supply voltage, the setting block including at least one bypass transistor arranged in parallel with at least one of the resistances corresponding thereto, the at least one bypass transistor each having a gate, at least one fuse each having one end thereof connected to the gate of a corresponding one of the at least one bypass transistor, and another end thereof grounded, at least one external voltage input terminal each connected to the one end of a corresponding one of the at least one fuse, and at least one pull-up transistor for pulling up the gate of the corresponding one of the at least one bypass transistor.

In another preferable form, the voltage divider comprises a plurality of resistances for dividing the external power supply voltage, the setting block including at least one bypass transistor arranged in parallel with at least one of the resistances corresponding thereto, the at least one bypass transistor each having a gate, at least one latch circuit each having an output terminal thereof connected to the gate of the corresponding one of the bypass transistor, the at least one latch circuit each having an input terminal, at least one fuse having one end thereof connected to the input terminal of a corresponding one of the at least one latch circuit, and another end thereof grounded, at least one external voltage input terminal each connected to the one end of a corresponding one of the at least one fuse, at least one pull-up transistor for pulling up the input terminal of the corresponding one of the at least one latch circuit, the at least one pull-up transistor each having a gate, and at least one control input terminal each connected to the gate of the corresponding one of the pull-up transistor.

In still another preferable form, the voltage divider comprises a plurality of resistances for dividing the external power supply voltage, the setting block including at least one nonvolatile bypass transistor arranged in parallel with at least one of the resistances corresponding thereto, the at least one bypass transistor each having a gate and a source, at least one pull-up transistor for pulling up the gate of a corresponding one of the at least one nonvolatile bypass transistor, at least one first external voltage input terminal each connected to the gate of the corresponding one of the at least one nonvolatile bypass transistor, and at least one second external voltage input terminal each connected to the source of the corresponding one of the at least one nonvolatile bypass transistor.

In a further preferable form, the voltage divider comprises a plurality of resistances for dividing the external power supply voltage, the setting block including at least one bypass transistor arranged in parallel with at least one corresponding resistance of the resistances, the at least one bypass transistor each having a gate, and an internal register block provided within the internal circuit and having a plurality of registers each connected to the gate of a corresponding one of the at least one bypass transistor, the ratio of the divided voltage to the external power supply voltage being set by controlling the internal register block.

More preferably, the integrated circuit comprises a plurality of internal circuits, the voltage dropping circuit being provided for each of the internal circuits.

To attain the above object, according to a third aspect of the invention, there is provided an integrated circuit including at least one voltage dropping circuit and at least one internal circuit both provided therein, the at least one voltage dropping circuit each operating to drop down an external power supply voltage to generate a dropped voltage, and supplying the dropped voltage to a corresponding one of the at least one internal circuit. The at least one voltage dropping circuit each comprises a voltage divider that divides the dropped voltage to obtain a divided voltage, a comparator that compares the divided voltage with a reference voltage, and generates a control voltage according to a result of the comparison, a voltage generator including at least one transistor, for generating the dropped voltage in response to the control voltage, and a setting block that sets a ratio of the divided voltage to the dropped voltage. The at least one transistor of the voltage generator has a chip size thereof determined to a value such that proper operation of a corresponding one of the at least internal circuit is ensured under worst operating conditions thereof, and the ratio of the divided voltage to the dropped voltage is determined to a value such that proper operation of the corresponding one of the at least one internal circuit is ensured under best operating conditions thereof, and at the same time the dropped voltage assumes a lowest value.

To attain the above object, according to a fourth aspect of the invention, there is provided an integrated circuit including at least one voltage dropping circuit and at least one internal circuit both provided therein, the at least one voltage dropping circuit each operating to drop an external power supply voltage to generate a dropped voltage, and supplying the dropped voltage to a corresponding one of the at least one internal circuit. The at least one voltage dropping circuit each comprises a voltage divider that divides the external power supply voltage to obtain a divided voltage, a comparator that compares the divided voltage with the dropped voltage, and generates a control voltage according to a result of the comparison, a voltage generator including at least one transistor, for generating the dropped voltage in response to the control voltage, and a setting block that sets a ratio of the divided voltage to the dropped voltage. The at least one transistor of the voltage generator has a chip size thereof determined to a value such that proper operation of a corresponding one of the at least internal circuit is ensured under worst operating conditions thereof, and the ratio of the divided voltage to the dropped voltage is determined to a value such that proper operation of the corresponding one of the at least one internal circuit is ensured under best operating conditions thereof, and at the same time the dropped voltage assumes a lowest value.

The above and other objects, features and advantages of the invention will become more apparent from the following detailed description taken in conjunction with the accompanying drawings.

DETAILED DESCRIPTION

The invention will now be described in detail with reference to the drawings showing embodiments thereof.

Figure 1:
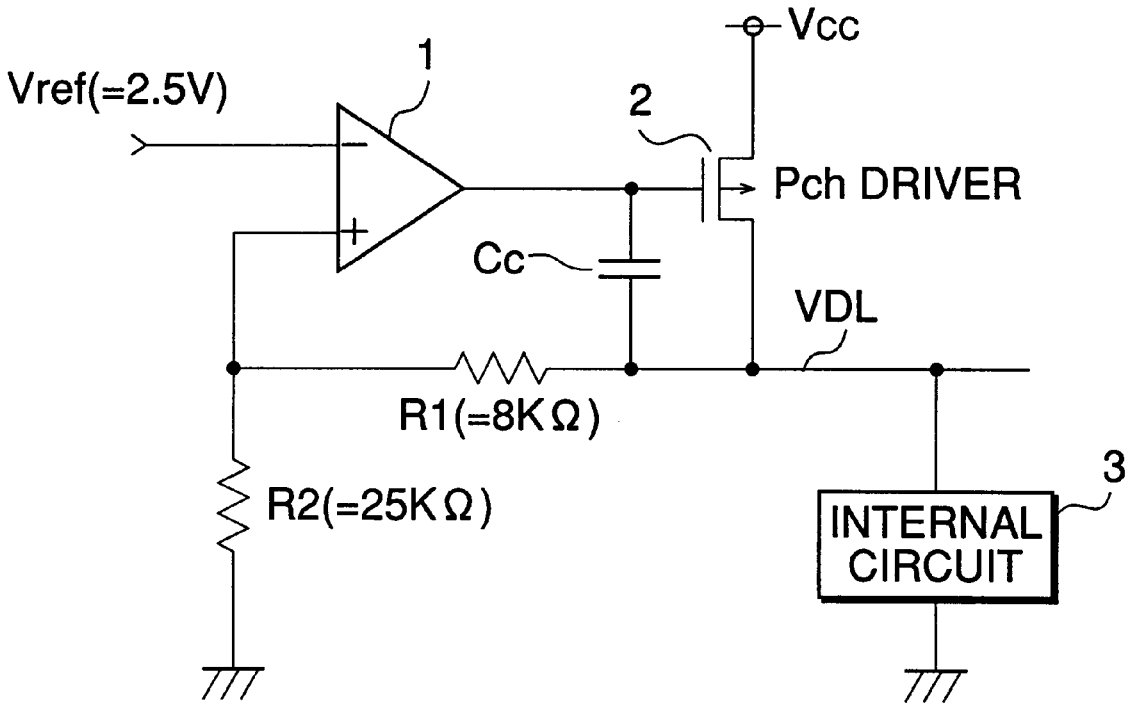
FIG.1 PRIOR ART
FIG. 1 is a circuit diagram showing the circuit configuration of a conventional voltage dropping circuit.
Figure 2:
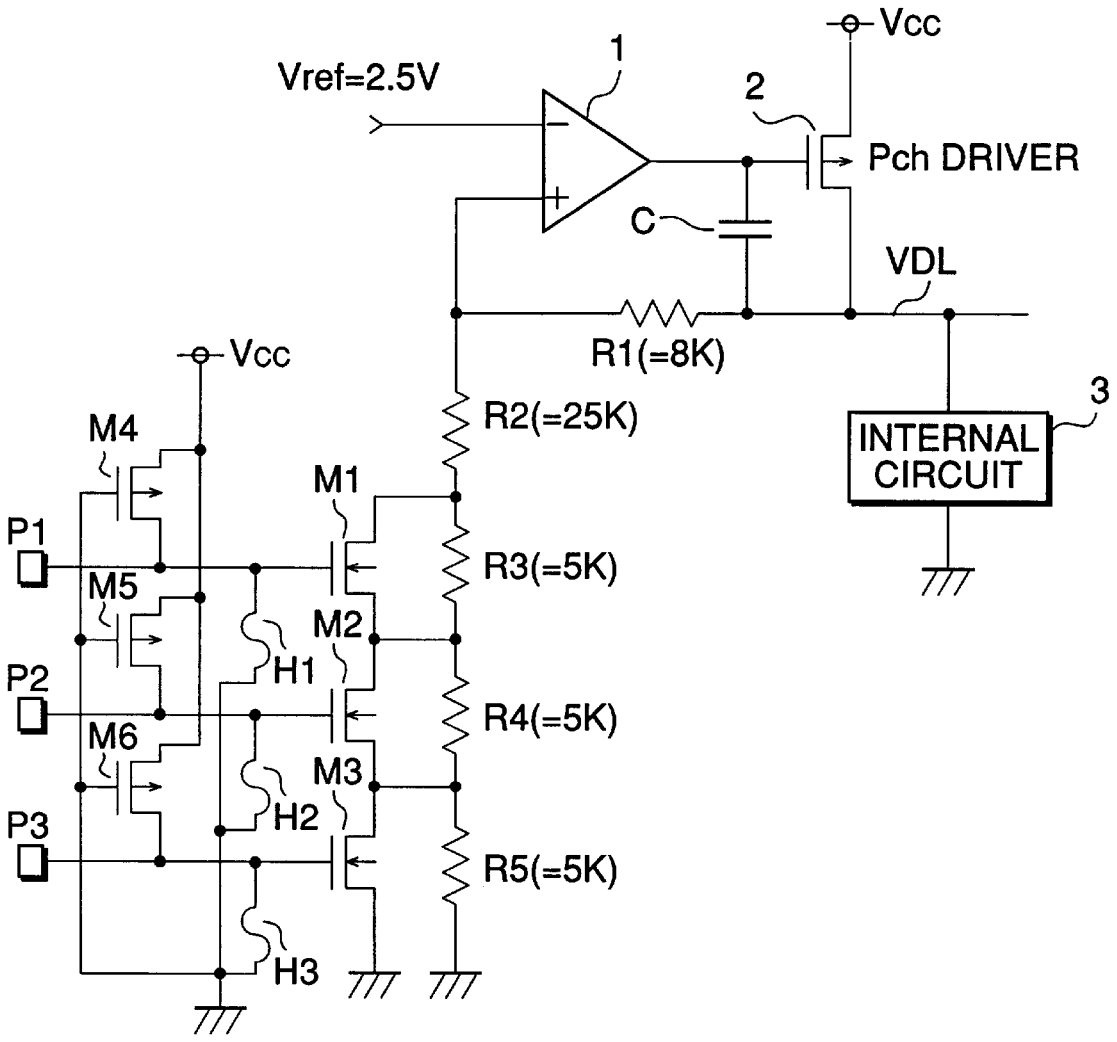
FIG. 2 is a circuit diagram showing the circuit configuration of a voltage dropping circuit according to a first embodiment of the invention.

Referring first to FIG. 2, there is shown the circuit configuration of a voltage dropping circuit according to a first embodiment of the invention. As shown in the figure, an operational amplifier 1 has an output terminal thereof connected to the gate of an FET (field effect transistor) 2. The FET 2 has a drain thereof connected to an internal circuit 3, for supplying dropped voltage VDL as power supply voltage to the internal circuit 3. Further, the dropped voltage VDL is divided by a voltage divider formed by a resistance R1 and a set of resistances R2 to R5, and the divided voltage is fed back to a positive input terminal of the operational amplifier 1, thus forming a feedback loop. To improve phase characteristics of the circuit, a capacitor C is connected between the gate and the drain of the FET 2. The capacitor C provides a Miller capacitance.

The width W of the FET 2 is determined by using the aforegiven equation (3) in the following manner: Under the worst conditions (of operation of transistors, including the environmental temperature), the allowable lower limit voltage of the operation margin of the internal circuit 3 is measured. Then, a voltage value which is the allowable lower limit voltage plus a certain margin is set, and then a peak current which flows when a voltage having this voltage value is supplied to the internal circuit 3 under the worst conditions is measured. Then, the width W of the FET 2 is determined such that the dropped voltage VDL does not become lower than the allowable lower limit voltage of the operation margin of the internal circuit 3 even when the peak current flows into the internal circuit 3. This ensures proper operation of the internal circuit 3 under the worst conditions.

In the figure, reference numerals M1 to M3 designate bypass transistors formed by respective NMOS (n-channel metal oxide semiconductor) transistors. The bypass transistor M1 is connected to opposite ends of the resistance R3, the bypass transistor M2 to opposite ends of the resistance R4, and the bypass transistor M3 to opposite ends of the resistance R5. Therefore, by setting ON and OFF conditions of the bypass transistors M1 to M3, the feedback gain of the operational amplifier 1 can be changed as desired.

Reference numerals H1 to H3 in FIG. 2 designate fuses, each of which has a predetermined resistance value and operates to melt and break (open) when an excessive amount of current flows therethrough. The fuses H1 to H3 are connected between gates of the respective bypass transistors M1 to M3 and ground. To open the fuses H1 to H3, it is required to apply to the fuses H1 to H3 a voltage which is higher than the gate voltage which causes the bypass transistors M1 to M3 to turn on. Reference numerals M4 to M6 designate transistors formed by PMOS (p-channel metal oxide semiconductor) transistors which serve to pull up the voltage of the gates of the respective bypass transistors M1 to M3. The transistors M4 to M6 have sources thereof supplied with power supply voltage Vcc, and gates thereof grounded, respectively. Further, the transistors M4 to M6 have drains thereof connected to the gates of the respective transistors M1 to M3. Reference numerals P1 to P3 designate external voltage input terminals which are connected to the gates of the respective bypass transistors M1 to M3 and hence associated ends of the respective fuses H1 to H3.

In the illustrated example, the resistance R2 is set to a value of 25 K Ω, and the resistances R3 to R4 are each set to 5 K Ω. When none of the fuses H1 to H3 are melt and broken, the gates of the transistors M1 to M3 are pulled down, so that all the bypass transistors M1 to M3 are turned off. In this case, the resistance connected between the positive input terminal of the operational amplifier 1 and the ground has a combined resistance value of the resistances R2 to R5 which is equal to 40 K Ω. Accordingly, the dropped voltage VDL is equal to 2.5 volts×(40 K+8 K)/40 K=3 volts.

When the fuse H3 is melted and broken by applying high voltage to the external voltage input terminal P3, the gate of the bypass transistor M3 is pulled up by the transistor M6, which causes the bypass transistor Mt3 to turn on. In this case, the resistance connected between the positive input terminal of the operational amplifier and the ground has a combined resistance value of the resistances R2 to R4 and the ON-state resistance value of the bypass transistor M3, which is almost equal to 35 K Ω. The ON-state resistance value of the bypass transistor M3 is generally in a range of several tens Ω to several hundreds Ω, which is negligible compared with the combined resistance value of the resistances R2 to R4 (=35 Ω). Therefore, the resistance connected between the positive input terminal of the operational amplifier and the ground can be regarded as almost equal to the combined resistance value of the resistances R2 to R4 (=35 K Ω). Accordingly, the dropped voltage VDL is equal to 2.5 volts×(35 K+8 K))/35 K=3.07 volts.

Thus, by suitably melting and breaking the fuses H1 to H3, the value of the resistance connected between the positive input terminal connected and the ground can be changed, whereby the dropped voltage VDL can be adjusted.

Now, the operation of the voltage dropping circuit according to the first embodiment constructed as above will be described with reference to FIG. 2.

As described above, the width W of the FET 2 is determined such that proper operation of the internal circuit 3 is ensured under the worst conditions (of operation of transistors, including environmental temperature). However, under the best conditions, the peak current of the internal circuit 3 becomes larger than a value under the worst conditions, resulting in an increased amount of current consumed by the internal circuit (consumption current). Further, as the peak current increases, the dropped voltage VDL can become lower than the allowable lower limit voltage of the operation margin of the internal circuit. In general, under the best conditions, the lower limit voltage of the operation margin tends to become lower than that under the worst conditions. Therefore, by changing the dropped voltage VDL according to variations between individual transistors resulting from delicate differences of actual conditions of the manufacturing process, it is possible to reduce the consumption current while ensuring proper operation of the internal circuit 3.

To change the dropped voltage VDL, it can be carried out e.g. during testing of a wafer of LSI's. In testing the wafer, the internal circuit 3 is operated under the best conditions, and then the dropped voltage is determined to such a value that proper operation of the internal circuit 3 is ensured. More specifically, first, settings are made such that the peak current flows through the internal circuit 3 operated under the best conditions. Then, the voltage is applied to the external voltage input terminals P1 to P3 to thereby cause the bypass transistors M1 to M3 to sequentially turn on. The dropped voltage VDL is progressively made higher to determine the ON/OFF conditions of the bypass transistors M1 to M3 to set the lower limit operating voltage at and above which the internal circuit 3 operates normally.

For example, in the case where the voltage is applied to the external voltage input terminal P3 alone, the internal circuit 3 malfunctions, whereas when voltage is applied to the external voltage input terminals P2 and P3 to cause the bypass transistors M2 and M3 to turn on, the internal circuit 3 operates properly, it is a necessary condition for proper operation of the internal circuit 3 that the bypass transistor M2 and M3 should be in ON states. The values of voltage to be applied to the external voltage input terminals P1 to P3 are set to values which do not cause melting and breaking of the fuses H1 to H3 while causing the bypass transistors M1 to M3 to turn on.

After the conditions for setting the lower limit operating voltage for normal operation of the internal circuit 3 (the lowest dropped voltage VDL) are determined in the above described manner, trimming of the fuses H1 to H3 is carried out. In the illustrated example, high voltage is applied to the external voltage input terminals P2 and P3 to melt and break the fuse H2 and H3, to thereby set the bypass transistors M2, M3 into ON states. This makes it possible to ensure reduction of the consumption current while ensuring proper operation of the internal circuit 3.

As described above, according to the present embodiment, the width of the FET 2, i.e. the chip size of the FET 2 is determined such that the internal circuit 3 operates properly under the worst conditions, and then the lowest dropped voltage VDL at and above which the internal circuit 3 operates properly is determined by actually operating the internal circuit 3 under the best conditions. This makes it possible to reduce the consumption voltage while ensuring proper operation of the internal circuit. Further, since the dropped voltage VDL can be adjusted after the internal circuit 3 is formed on the wafer, a product which is defective due to shortage of the power supply voltage margin can be changed into a conforming product by setting the dropped voltage to a higher value, which leads to an enhanced yield.

Now, a second embodiment of the invention will be described with reference to FIG. 3. This embodiment is distinguished from the first embodiment described above in that latch circuits are provided for holding the gate voltages of the respective bypass transistors M1 to M3, and the transistors M4 to M6 are supplied with a standby signal STB which is set to a high level when the LSI is in a standby state. The remainder of the configuration of this embodiment is similar to that of the first embodiment. Therefore, for example, the trimming of the fuses H2 to H3 is carried out by actually operating the internal circuit 3 in a similar manner to the first embodiment. Those which are different from the first embodiment will be described in detail hereinbelow.

The standby state is a state in which the LSI is supplied with the power supply voltage Vcc, but not in actual operation. In the voltage dropping circuit shown in FIG. 2, current flows through the transistors M4 to M6 and the fuses H1 to H3 when the LSI is in the standby state. For instance, if the fuse H3 opens and at the same time the fuses H1 and H2 remain connected, the input impedance of the bypass transistor M3 viewed from the gate is very large such that current hardly flows through a route from the transistor M6 to the bypass transistor M3. However, current flows through a route from the transistor M5 to the fuse H2 and a route from the transistor M4 to the fuse H1. The second embodiment eliminates this inconvenience, by preventing such current flow.

Figure 3:
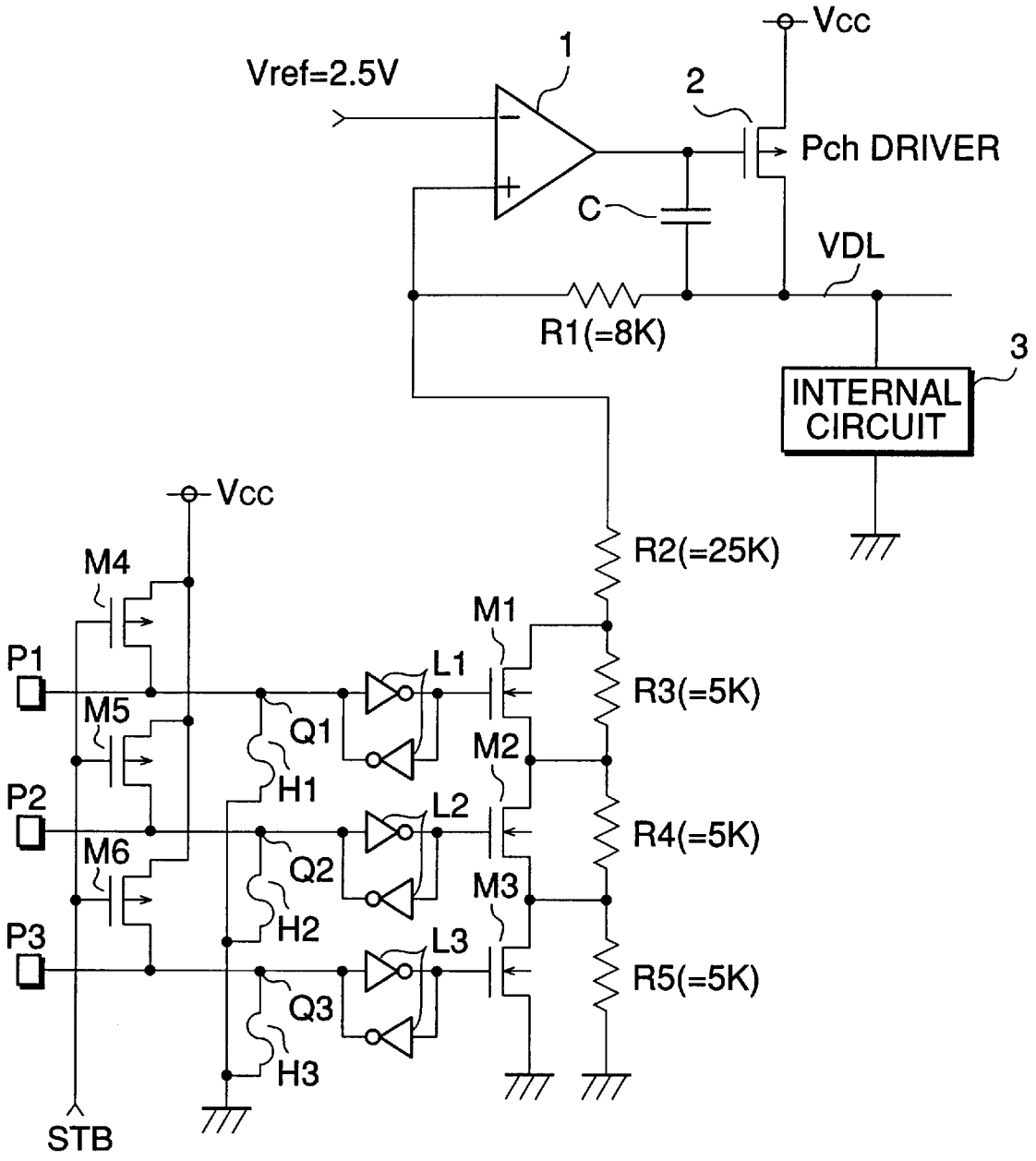
FIG. 3 is a circuit diagram showing the circuit configuration of a voltage dropping circuit according to a second embodiment of the invention.

Referring to FIG. 3, reference numerals L1 to L3 designate latch circuits, each formed by two inverters with an input of one inverter being connected to an output of the other. In the latch circuits L1 to L3, the input and output levels are inverted to each other, and when the input side is turned into a high-impedance state, the output side is maintained at a level assumed before the input side is turned into the high-impedance state. The standby signal STB is supplied to the gates of the transistors M4 to M6. When the standby signal STB is changed into a high level, the transistors M4 to M6 turn off. This prevents current from flowing through the transistors M4 to M6 and the fuses H1 to H3, thereby reducing the consumption current.

Let it now be assumed that the fuses H1 and H2 open but the fuse H3 remains connected. Then, the transistors M4 and M5 are turned off when the LSI is on standby, and the latch circuits L1 and L2 maintain an output level assumed before the LSI is brought into the standby state. When the standby signal STB is at a low level, the voltage levels at the junctions Q1 and Q2 are at a high level, and accordingly the output levels from the latch circuits L1 and L2 become low. Thus, the outputs from the latch circuits L1 and L2 remain low in level even when the LSI is on standby. Further, the voltage at the junction Q3 in the standby state of the LSI is pulled down by the fuse H3 to a low level, which changes the output from the latch circuit L3 into a high level. Therefore, irrespective of whether the LSI is on standby or not, the bypass transistors M1 and M2 are always in OFF states, whereas the bypass transistor M3 is always in an ON state.

As describe above, according to the second embodiment, the consumption current in the standby state of the LSI can be reduced while maintaining the dropped voltage at a constant level.

Figure 4:
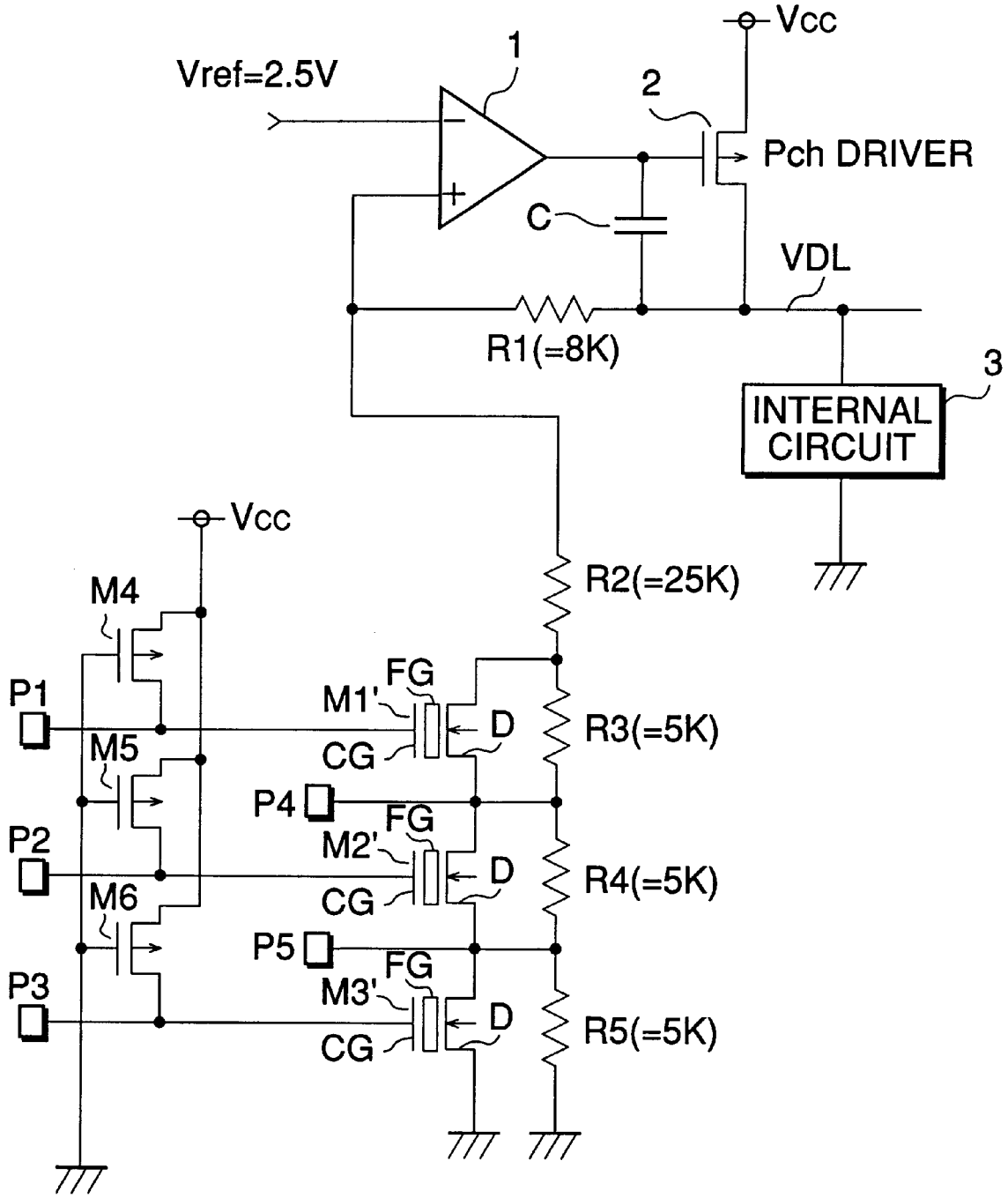
FIG. 4 is a circuit diagram showing the circuit configuration of a voltage dropping circuit according to a third embodiment of the invention.

Now, a third embodiment of the invention will be described with reference to FIG. 4. This embodiment is distinguished from the first embodiment in that the fuses H1 to H3 are replaced by bypass transistors M1' to M3' which each function as a memory, and external voltage input terminals P4 and P5 are additionally provided. Those which are different from the first embodiment will be described in detail hereinbelow.

The bypass transistors M1' to M3' each have a floating gate FG in addition to the control gate CG. When high voltage is applied between the control gate CG and the drain D, electrons are injected into the floating gate FG and accumulated therein, which causes formation of a p-channel layer between the source and the drain so that the bypass transistors M1' to M3' turn on. Due to the accumulation of electrons in the floating gate FG, the bypass transistors M1' to M3' are held in the ON state even after the high voltage ceases to be applied between the control gage CG and the drain D. In this sense, the bypass transistors M1' to M3' can be regarded as "nonvolatile memory devices".

To utilize this function of the transistors M1' to M3', according to the present embodiment, instead of the trimming of the fuses H1 to H3 employed in the first embodiment, a process for writing into the bypass transistors M1' to M3' is carried out. To turn the bypass transistor M1' on to bypass the resistance R3, high voltage is applied between the external voltage input terminals P1 and P4, while to turn the bypass transistor M2' on to bypass the resistance R4, high voltage is applied between the external voltage input terminals P2 and P5. Further, to turn the bypass transistor M3' on, high voltage is applied between the external voltage input terminal P3 and the ground.

As described above, according to the present embodiment, the fuses H1 to H3 and the latch circuits L1 to L3 employed in the first and second embodiments are not required. Therefore, it is possible to reduce the chip area of the voltage dropping circuit. Further, since the fuses H1 to H3 are not used, no current flows through the fuses H1 to H3. Further, the omission of the fuses H1 to H3 saves the amount of current that should flow through the fuses, making it possible to reduce the consumption current.

The invention is not limited to the above described embodiments, but various variations thereof are possible, which include the following variations, discussed below.

Although in the second embodiment, the gates of the transistors M4 to M6 are each set to a low level to permit current to flow through the fuses H1 to H3 except when the LSI is on standby, this is not limitative, but it may be designed such that the gates of the transistors M4 to M6 are set to a low level only during initialization of the LSI (over a predetermined time period immediately after the start of supply of the power supply voltage Vcc). In this case, current flows through the fuses H1 to H3 only over a very short time period of initialization, and hence it is possible to further reduce the consumption current.

Further, although in the above embodiments, the setting of the dropped voltage VDL is carried out during testing of the wafer, semi-finished products before setting the dropped voltage VDL may be shipped as finished products. In this case, the user is permitted to set the dropped voltage VDL, according to the use of the LSI. For example, when high reliability of the LSI is demanded, the dropped voltage VDL may be set to a relative high voltage to secure a larger operation margin of the LSI, whereas when low consumption current is demanded, the dropped voltage VDL may be set to a relatively low voltage at a certain cost to the operating margin of the LSI.

Further, although in the above embodiments, the bypass transistors M1 to M3 and M1' to M3' are connected to the opposite ends of respective resistances interposed between the positive input terminal of the operational amplifier and the ground, this is not limitative, but the feedback resistance R1 may be formed by a plurality of divided resistances, and the bypass transistors may be connected to opposite ends of each of the divided resistances. In short, any circuit configuration may be employed insofar as it can vary the dropped voltage VDL.

Figure 5:
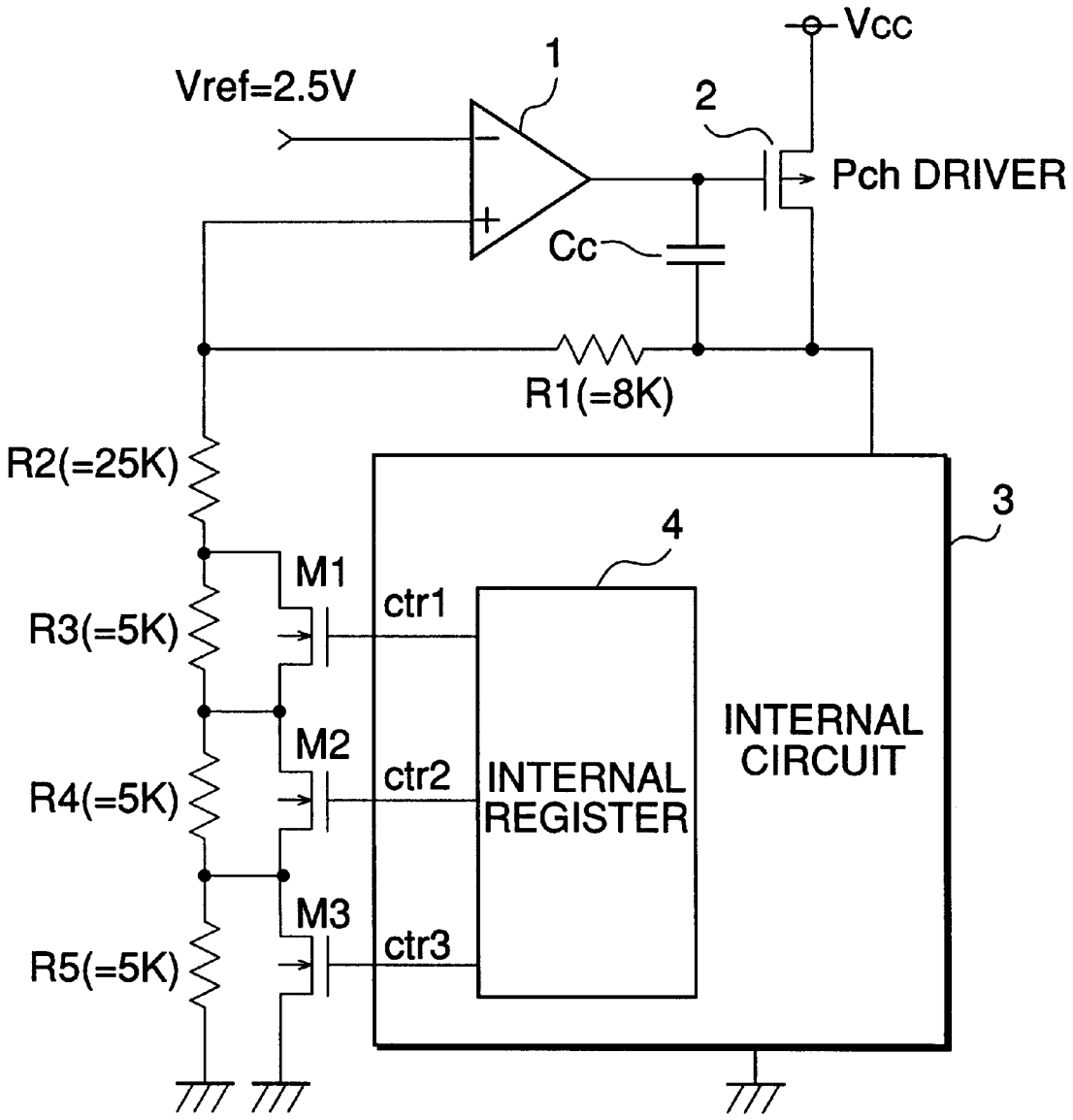
FIG. 5 is a circuit diagram showing the circuit configuration of a voltage dropping circuit according to a fourth embodiment of the invention.

Now, a fourth embodiment of the invention will be described with reference to FIG. 5. This embodiment is distinguished from the first embodiment in that the bypass transistors M1 to M3 are controlled by internal registers within the internal circuit. More specifically, the gates of the bypass transistors M1 to M3 are connected to a plurality of registers of an internal register block 4 within the internal circuit, i.e. logical circuits which are set to a high level or a low level, i.e. the power supply voltage of 5 volts or the ground voltage of 0 volts, by respective first control signals generated within the internal circuit 3, whereby second control signals ctr1 to ctr3 which are at a high or low level correspondingly to the set levels of the respective registers of the register block 4 are supplied to the gates of the respective bypass transistors M1 to M3. The remainder of the circuit configuration of this embodiment is similar to that of the first embodiment. With this construction, to set the dropped voltage VDL, the internal circuit 3 is operated under the best conditions, while the first control signals are sequentially generated so as to sequentially set the second control signals ctr1 to ctr3 from the registers into a high level and thereby cause the bypass transistors M1 to M3 to sequentially turn on. Accordingly, the dropped voltage VDL is progressively increased to determine the ON/OFF conditions of the bypass transistors M1 to M3 to set the lower limit operating voltage at and above which the internal circuit 3 operates normally. When the lower limit operating voltage has thus been determined, the internal circuit 3 is set to this state, i.e. a state where the first control signals are held at the respective levels assumed at this time. Further, in the present embodiment as well, the levels of the first control signals can be set such that a high power supply voltage (the dropped voltage VDL set as stated above) is supplied to the internal circuit 3 when it is in operation, while a low power supply voltage is supplied to the internal circuit 3 when it is on standby.

Figure 6:
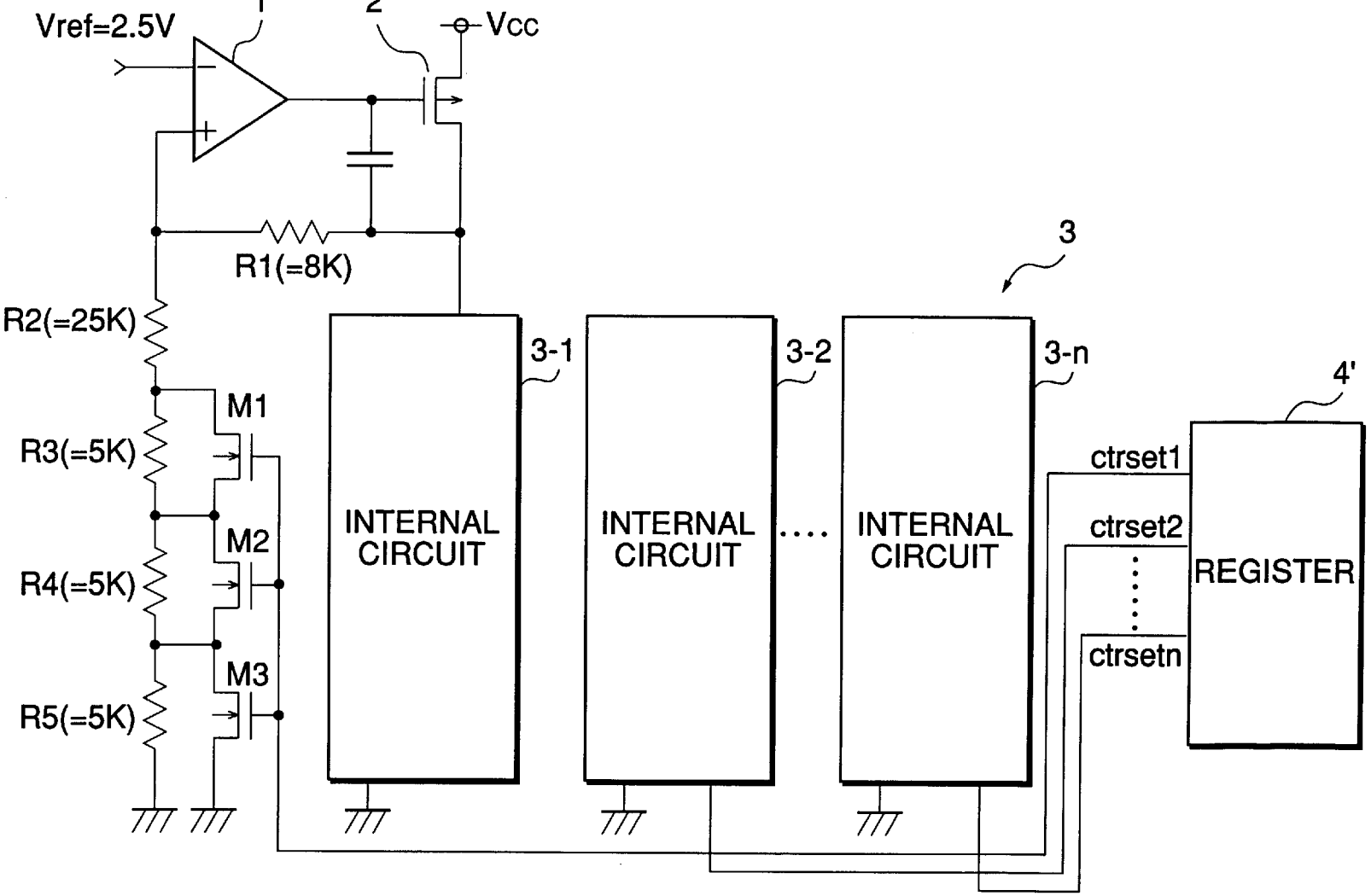
FIG. 6 is a circuit diagram showing the circuit configuration of a variation of the fourth embodiment.

Next, a fifth embodiment of the invention will be described with reference to FIG. 6. This embodiment is a further development of the fourth embodiment described above, and distinguished therefrom in that the internal circuit 3 is divided into a plurality of sections 3-1 to 3-n which are separately supplied with dropped voltages from respective voltage dropping circuits which each have its output controlled by second control signals from internal registers of a register block within the internal circuit 3. In FIG. 6, only a voltage dropping circuit similar in construction to that of the first embodiment, which is associated with one section 3-1 of the divided sections 3-1 to 3-n is illustrated, for the sake of simplicity. Further, for the sake of simplicity, an internal register block 4' is shown in one block separate from the internal circuit 3, which supplies n sets of second control signals ctrset1 to ctrsetn to the respective sections 3-1 to 3-n. The control signal sets ctrset1 to ctrsetn are each for supplying voltages separately to the gates of the bypass resistances M1 to M3 of a corresponding voltage dropping circuit, but for the sake of simplicity, they are each collectively shown by a single line. The remainder of the circuit configuration of this embodiment is similar to that of the fourth embodiment. According to the present embodiment, it is possible to supply the optimum voltage to each of the sections e.g. by supplying a lower voltage to a section which is low in operating speed and may be supplied with a low voltage.

Figure 7:
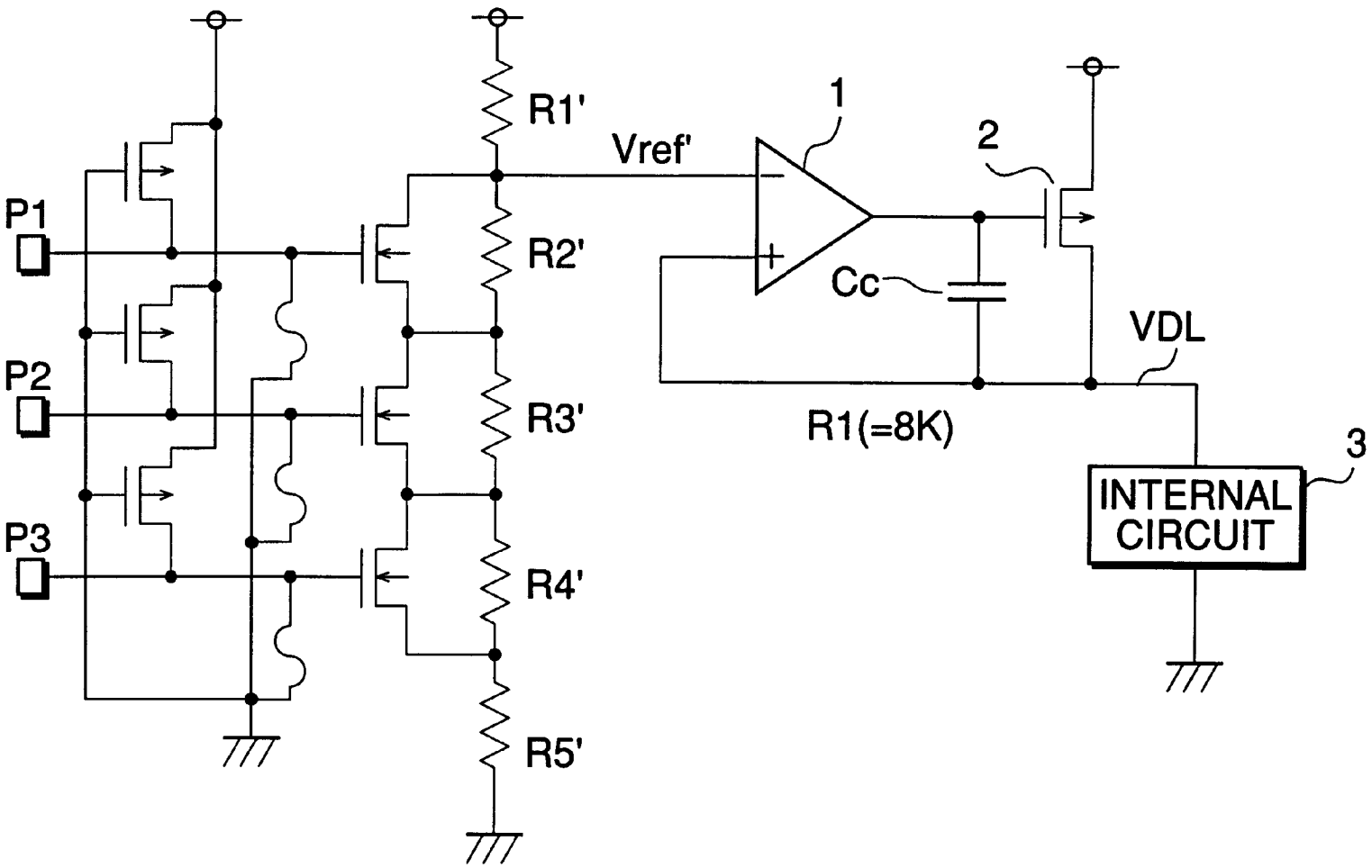
FIG. 7 is a circuit diagram showing the circuit configuration of a voltage dropping circuit according to a fifth embodiment of the invention.
Figure 8:
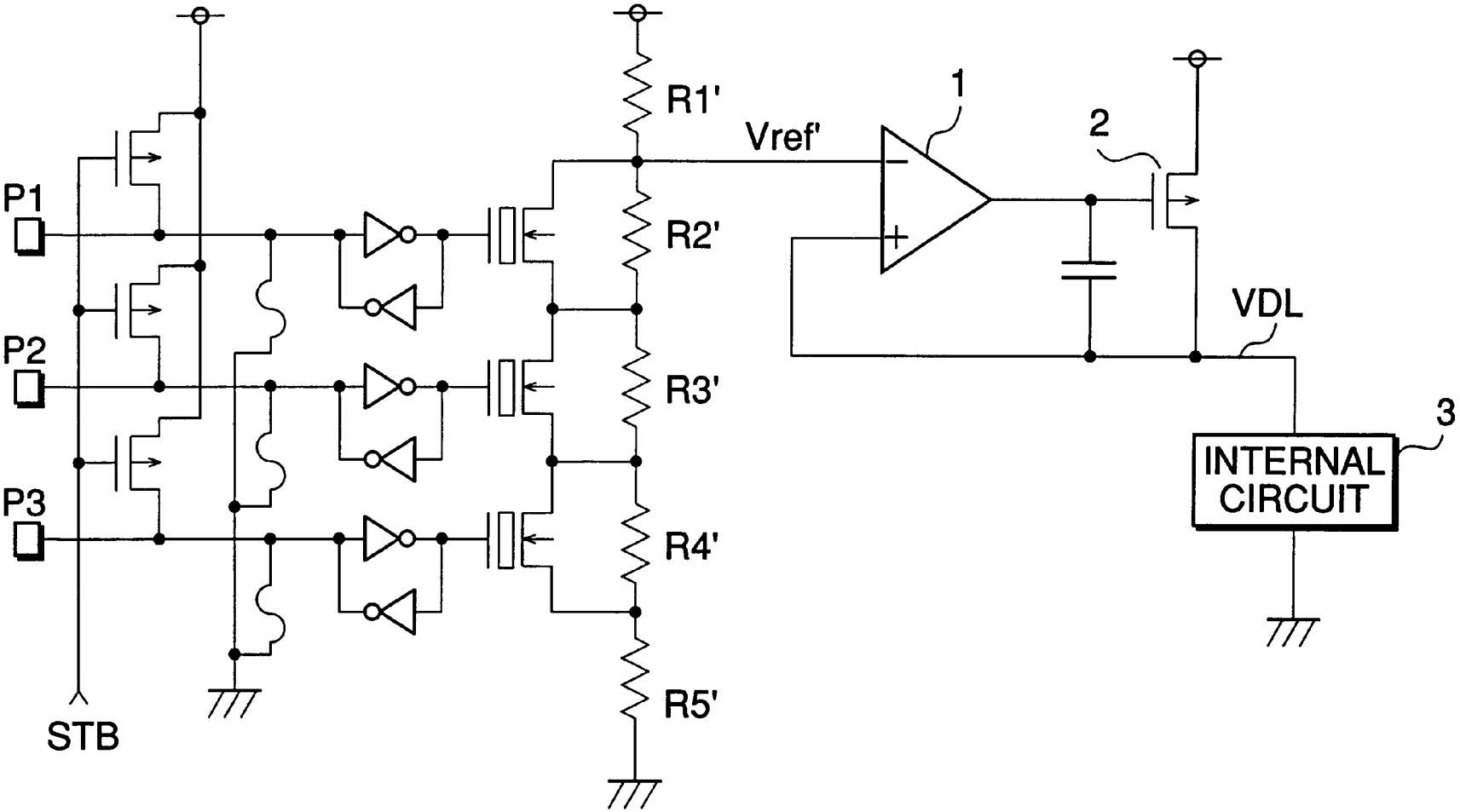
FIG. 8 is a circuit diagram showing the circuit configuration of a first variation of the voltage dropping circuit according to the fifth embodiment.
Figure 9:
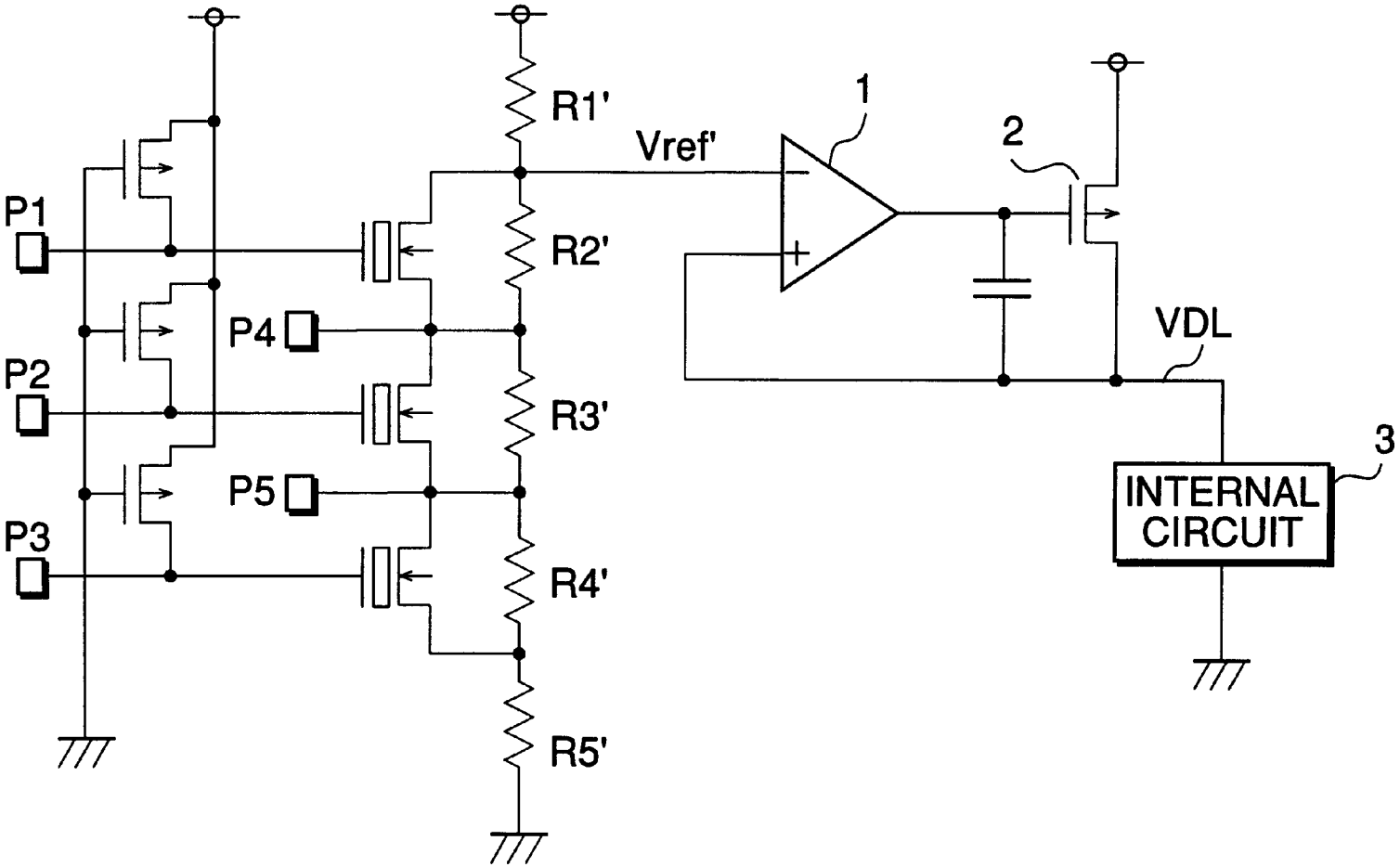
FIG. 9 is a circuit diagram showing the circuit configuration of a second variation of the fifth embodiment.
Figure 10:
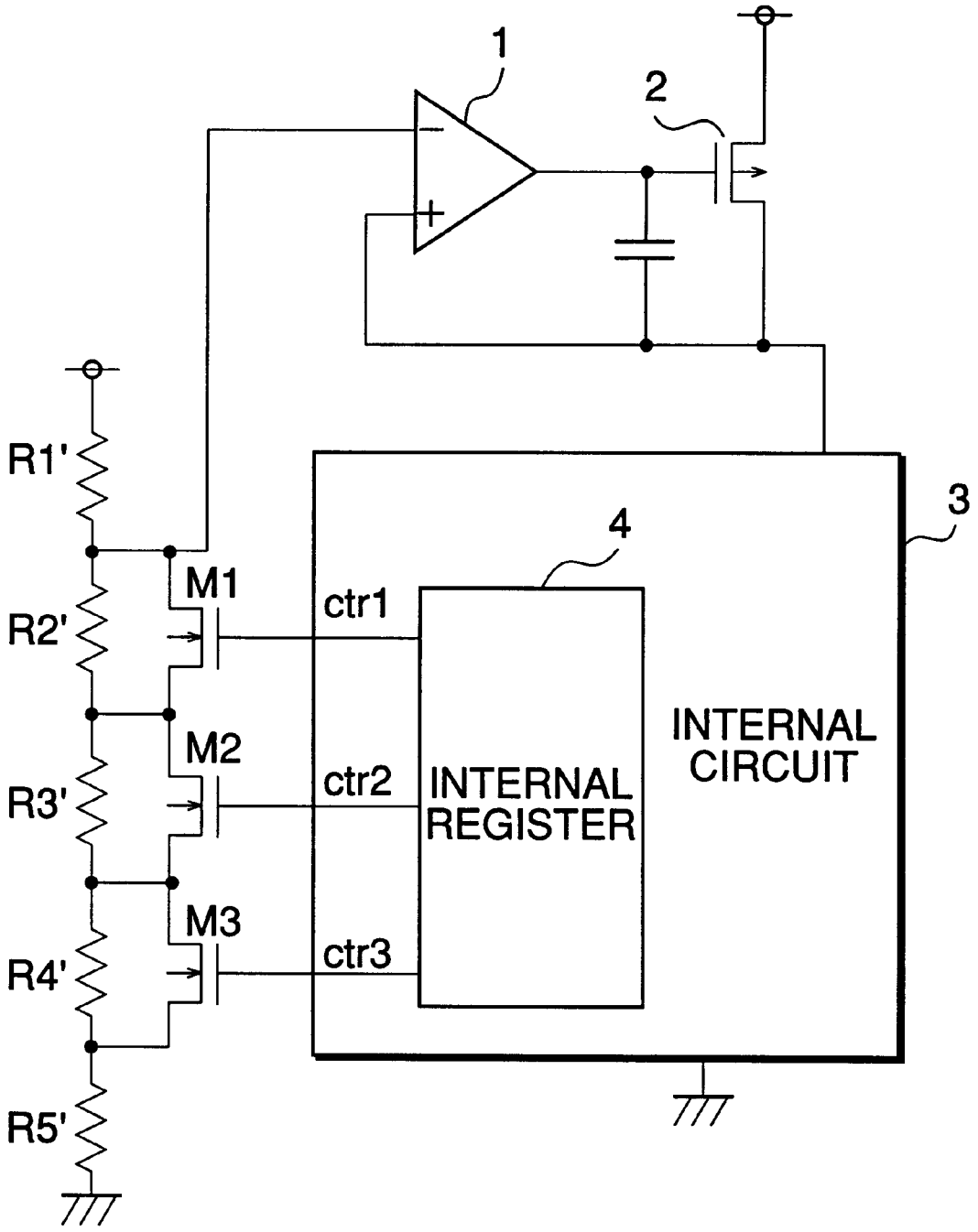
FIG. 10 is a circuit diagram showing the circuit configuration of a third variation of the fifth embodiment.
Figure 11:
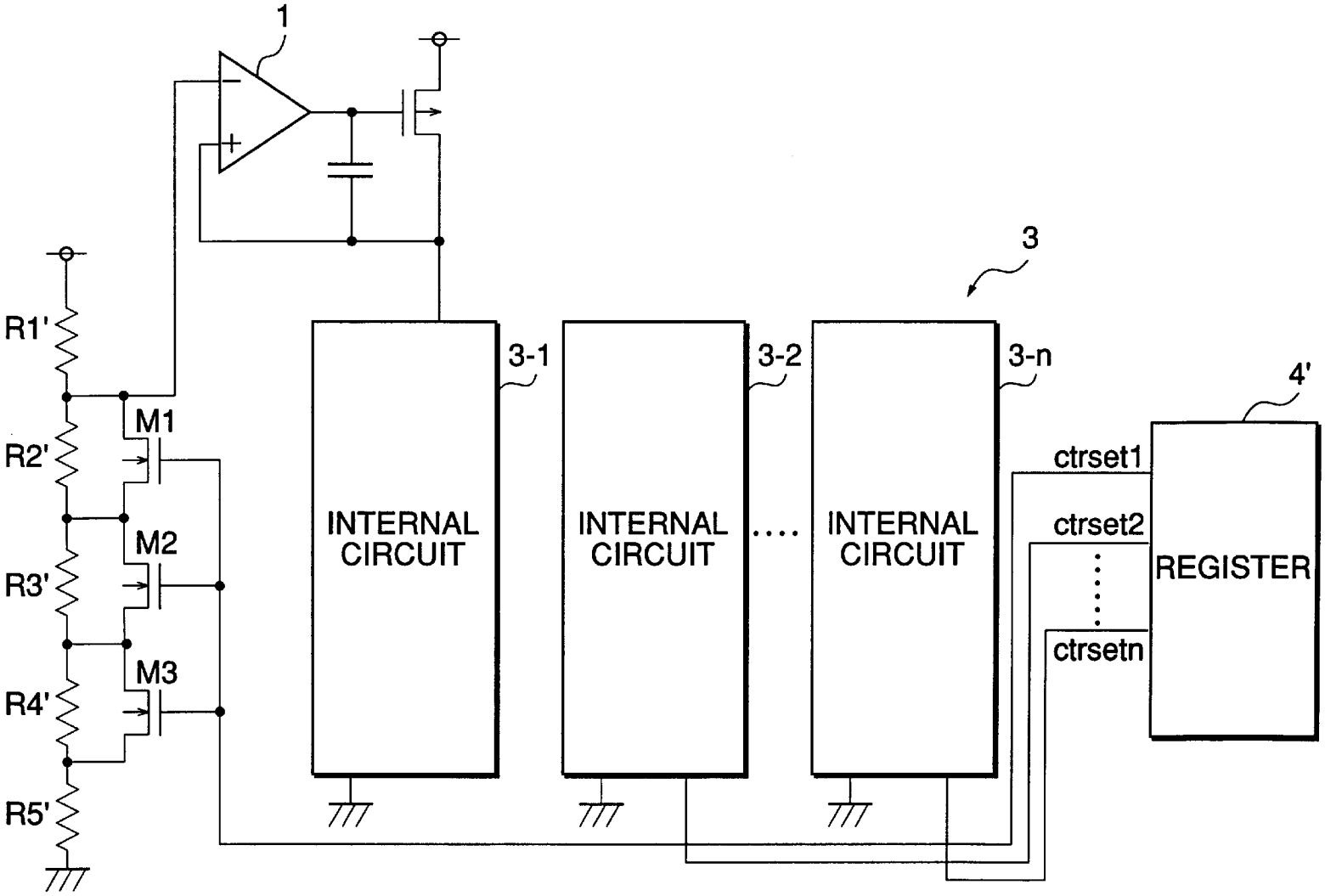
FIG. 11 is a circuit diagram showing the circuit configuration of a fourth variation of the fifth embodiment.

FIG. 7 shows a sixth embodiment of the invention. An operational amplifier as employed in the voltage dropping circuit of the invention generally operates such that the reference voltage Vref' applied to the negative input terminal thereof and a voltage applied to the positive input terminal become equal to each other. Therefore, in the operational amplifier 1 of the voltage dropping circuit, the dropped voltage VDL can be controlled by controlling the reference voltage Vref. In the present embodiment, one end of the voltage divider is directly connected to the power supply voltage Vcc and a divided voltage obtained similarly to the first embodiment, i.e. a voltage at a junction of the resistance R1' and the resistance R2' is applied to the negative input terminal of the operational amplifier 1 as a reference voltage Vref', while the drain voltage of the FET 2, i.e. the dropped voltage VDL is directly applied to the positive input terminal of the operational amplifier 1. The remainder of the circuit configuration of this embodiment is similar to that of the first embodiment. According to this present embodiment, it is possible to obtain substantially the same advantageous effects as obtained by the first embodiment.

FIGS. 8 to 11 show first to fourth variations of the sixth embodiment in which the concept of the sixth embodiment is applied to the second, third, fourth, and fifth embodiments, respectively, each of which is distinguished from a corresponding one of the second to fifth embodiments in that the voltage divider constructed similarly to the corresponding one of them divides the power supply voltage and the divided voltage is applied to the negative input terminal of the operational amplifier 1 as a reference voltage. The remainder of the circuit configuration of this embodiment is similar to that of the first embodiment, and therefore description thereof is omitted. According to these variations, it is possible to obtain substantially the same advantageous effects as obtained by the second to fifth embodiments.

What is claimed is:

1. An integrated circuit having at least one internal circuit and additionally a voltage dropping circuit for dropping an external power supply voltage to generate a dropped voltage, and supplying said dropped voltage to said at least one internal circuit, the voltage dropping circuit comprising:

a voltage divider that divides said dropped voltage to obtain a divided voltage;

a comparator that compares said divided voltage with a reference voltage, and generates a control voltage according to a result of the comparison;

a voltage generator that generates said dropped voltage in response to said control voltage; and a setting block that sets a ratio of said divided voltage to said dropped voltage to one of plural different values, wherein said ratio of said divided voltage to said dropped voltage is set to a value at which said dropped voltage assumes a lowest value and proper operation of said at least one internal circuit is ensured under best operating conditions thereof.

2. An integrated circuit having at least one internal circuit and additionally a voltage dropping circuit for dropping an external power supply voltage to generate a dropped voltage, and supplying said dropped voltage to said at least one internal circuit, the voltage dropping circuit comprising:

a voltage divider that divides said dropped voltage to obtain a divided voltage, wherein said voltage divider comprises a plurality of resistances for dividing said dropped voltage;

a comparator that compares said divided voltage with a reference voltage, and generates a control voltage according to a result of the comparison:

a voltage generator that generates said dropped voltage in response to said control voltage;

a setting block that sets a ratio of said divided voltage to said dropped voltage, said setting block including:

at least one bypass transistor arranged in parallel with at least one of said resistances corresponding thereto, said at least one bypass transistor each having a gate;

at least one fuse each having one end thereof connected to said gate of a corresponding one of said at least one bypass transistor, and another end thereof grounded;

at least one external voltage input terminal each connected to said one end of a corresponding one of said at least one fuse; and at least one pull-up transistor for pulling up said gate of said corresponding one of said at least one bypass transistor.

3. An integrated circuit having at least one internal circuit and additionally a voltage dropping circuit for dropping an external power supply voltage to generate a dropped voltage, and supplying said dropped voltage to said at least one internal circuit, the voltage dropping circuit comprising:

a voltage divider that divides said dropped voltage to obtain a divided voltage, wherein said voltage divider comprises a plurality of resistances for dividing said dropped voltage;

a comparator that compares said divided voltage with a reference voltage, and generates a control voltage according to a result of the comparison;

a voltage generator that generates said dropped voltage in response to said control voltage;

a setting block that sets a ratio of said divided voltage to said dropped voltage, said setting block including:

at least one bypass transistor arranged in parallel with at least one of said resistances corresponding thereto, said at least one bypass transistor each having a gate;

at least one latch circuit each having an output terminal thereof connected to said gate of said corresponding one of said bypass transistor, said at least one latch circuit each having an input terminal;

at least one fuse each having one end thereof connected to said input terminal of a corresponding one of said at least one latch circuit, and another end thereof grounded;

at least one external voltage input terminal each connected to said one end of a corresponding one of said at least one fuse;

at least one pull-up transistor for pulling up said input terminal of said corresponding one of said at least one latch circuit, said at least one pull-up transistor each having a gate; and at least one control input terminal each connected to said gate of said corresponding one of said at least one pull-up transistor.

4. An integrated circuit having at least one internal circuit and additionally a voltage dropping circuit for dropping an external power supply voltage to generate a dropped voltage, and supplying said dropped voltage to said at least one internal circuit, the voltage dropping circuit comprising:

a voltage divider that divides said dropped voltage to obtain a divided voltage, wherein said voltage divider comprises a plurality of resistances for dividing said dropped voltage;

a comparator that compares said divided voltage with a reference voltage, and generates a control voltage according to a result of the comparison;

a voltage generator that generates said dropped voltage in response to said control voltage;

a setting block that sets a ratio of said divided voltage to said dropped voltage, said setting block including:

at least one nonvolatile bypass transistor arranged in parallel with at least one of said resistances corresponding thereto, said at least one bypass transistor each having a gate and a source;

at least one pull-up transistor for pulling up said gate of a corresponding one of said at least one nonvolatile bypass transistor;

at least one first external voltage input terminal each connected to said gate of said corresponding one of said at least one nonvolatile bypass transistor; and at least one second external voltage input terminal each connected to said source of said corresponding one of said at least one nonvolatile bypass transistor.

5. An integrated circuit having at least one internal circuit and additionally a voltage dropping circuit for dropping an external power supply voltage to generate a dropped voltage, and supplying said dropped voltage to said at least one internal circuit, the voltage dropping circuit comprising:

a voltage divider that divides said dropped voltage to obtain a divided voltage, wherein said voltage divider comprises a plurality of resistances for dividing said dropped voltage;

a comparator that compares said divided voltage with a reference voltage, and generates a control voltage according to a result of the comparison;

a voltage generator that generates said dropped voltage in response to said control voltage;

a setting block that sets a ratio of said divided voltage to said dropped voltage, said setting block including:

at least one bypass transistor arranged in parallel with at least one of said resistances corresponding thereto, said at least one bypass transistor each having a gate; and an internal register block provided within said internal circuit and having a plurality of registers each connected to said gate of a corresponding one of said at least one bypass transistor, said ratio of said divided voltage to said dropped voltage being set by controlling said internal register block.

6. A voltage dropping circuit according to claim 5, wherein said integrated circuit comprises a plurality of internal circuits, said voltage dropping circuit being provided for each of said internal circuits.

7. An integrated circuit having at least one internal circuit and additionally a voltage dropping circuit for dropping an external power supply voltage to generate a dropped voltage, and supplying said dropped voltage to said at least one internal circuit, the voltage dropping circuit comprising:

a voltage divider that divides said external power supply voltage to obtain a divided voltage;

a comparator that compares said divided voltage with said dropped voltage, and generates a control voltage according to a result of the comparison;

a voltage generator that generates said dropped voltage in response to said control voltage; and a setting block that sets a ratio of said divided voltage to said dropped voltage to one of plural different values, wherein said ratio of said divided voltage to said dropped voltage is set to a value at which said dropped voltage assumes a lowest value and proper operation of said at least one internal circuit is ensured under best operating conditions thereof.

8. An integrated circuit having at least one internal circuit and additionally a voltage dropping circuit for dropping an external power supply voltage to generate a dropped voltage, and supplying said dropped voltage to said at least one internal circuit, the voltage dropping circuit comprising:

a voltage divider that divides said external power supply voltage to obtain a divided voltage, wherein said voltage divider comprises a plurality of resistances for dividing said external power supply voltage;

a comparator that compares said divided voltage with said dropped voltage, and generates a control voltage according to a result of the comparison;

a voltage generator that generates said dropped voltage in response to said control voltage;

a setting block that sets a ratio of said divided voltage to said dropped voltage, said setting block including:

at least one bypass transistor arranged in parallel with at least one of said resistances corresponding thereto, said at least one bypass transistor each having a gate;

at least one fuse each having one end thereof connected to said gate of a corresponding one of said at least one bypass transistor, and another end thereof grounded;

at least one external voltage input terminal each connected to said one end of a corresponding one of said at least one fuse; and at least one pull-up transistor for pulling up said gate of said corresponding one of said at least one bypass transistor.

9. An integrated circuit having at least one internal circuit and additionally a voltage dropping circuit for dropping an external power supply voltage to generate a dropped voltage, and supplying said dropped voltage to said at least one internal circuit, the voltage dropping circuit comprising:

a voltage divider that divides said external power supply voltage to obtain a divided voltage, wherein said voltage divider comprises a plurality of resistances for dividing said external power supply voltage;

a comparator that compares said divided voltage with said dropped voltage, and generates a control voltage according to a result of the comparison;

a voltage generator that generates said dropped voltage in response to said control voltage;

a setting block that sets a ratio of said divided voltage to said dropped voltage, said setting block including:

at least one bypass transistor arranged in parallel with at least one of said resistances corresponding thereto, said at least one bypass transistor each having a gate;

at least one latch circuit each having an output terminal thereof connected to said gate of said corresponding one of said bypass transistor, said at least one latch circuit each having an input terminal;

at least one fuse having one end thereof connected to said input terminal of a corresponding one of said at least one latch circuit, and another end thereof grounded;

at least one external voltage input terminal each connected to said one end of a corresponding one of said at least one fuse;

at least one pull-up transistor for pulling up said input terminal of said corresponding one of said at least one latch circuit, said at least one pull-up transistor each having a gate; and at least one control input terminal each connected to said gate of said corresponding one of said pull-up transistor.

10. An integrated circuit having at least one internal circuit and additionally a voltage dropping circuit for dropping an external power supply voltage to generate a dropped voltage, and supplying said dropped voltage to said at least one internal circuit, the voltage dropping circuit comprising:

a voltage divider that divides said external power supply voltage to obtain a divided voltage, wherein said voltage divider comprises a plurality of resistances for dividing said external power supply voltage;

a comparator that compares said divided voltage with said dropped voltage, and generates a control voltage according to a result of the comparison;

a voltage generator that generates said dropped voltage in response to said control voltage;

a setting block that sets a ratio of said divided voltage to said dropped voltage, said setting block including:

at least one nonvolatile bypass transistor arranged in parallel with at least one of said resistances corresponding thereto, said at least one bypass transistor each having a gate and a source;

at least one pull-up transistor for pulling up said gate of a corresponding one of said at least one nonvolatile bypass transistor;

at least one first external voltage input terminal each connected to said gate of said corresponding one of said at least one nonvolatile bypass transistor; and at least one second external voltage input terminal each connected to said source of said corresponding one of said at least one nonvolatile bypass transistor.

11. An integrated circuit having at least one internal circuit and additionally a voltage dropping circuit for dropping an external power supply voltage to generate a dropped voltage, and supplying said dropped voltage to said at least one internal circuit, the voltage dropping circuit comprising:

a voltage divider that divides said external power supply voltage to obtain a divided voltage, wherein said voltage divider comprises a plurality of resistances for dividing said external power supply voltage;

a comparator that compares said divided voltage with said dropped voltage, and generates a control voltage according to a result of the comparison;

a voltage generator that generates said dropped voltage in response to said control voltage;

a setting block that sets a ratio of said divided voltage to said dropped voltage, said setting block including:

at least one bypass transistor arranged in parallel with at least one of said resistances corresponding thereto, said at least one bypass transistor each having a gate; and an internal register block provided within said internal circuit and having a plurality of registers each connected to said gate of a corresponding one of said at least one bypass transistor, said ratio of said divided voltage to said external power supply voltage being set by controlling said internal register block.

12. A voltage dropping circuit according to claim 11, wherein said integrated circuit comprises a plurality of internal circuits, said voltage dropping circuit being provided for each of said internal circuits.

13. An integrated circuit including at least one voltage dropping circuit and at least one internal circuit both provided therein, said at least one voltage dropping circuit each operating to drop an external power supply voltage to generate a dropped voltage, and supplying said dropped voltage to a corresponding one of said at least one internal circuit, the at least one voltage dropping circuit each comprising:

a voltage divider that divides said dropped voltage to obtain a divided voltage;

a comparator that compares said divided voltage with a reference voltage, and generates a control voltage according to a result of the comparison;

a voltage generator including at least one transistor, for generating said dropped voltage in response to said control voltage; and a setting block that sets a ratio of said divided voltage to said dropped voltage, wherein said at least one transistor of said voltage generator having a chip size thereof determined to a value such that proper operation of a corresponding one of said at least one internal circuit is ensured under worst operating conditions thereof; and wherein said ratio of said divided voltage to said dropped voltage is determined to a value such that proper operation of said corresponding one of said at least one internal circuit is ensured under best operating conditions thereof, and at the same time said dropped voltage assumes a lowest value.

14. An integrated circuit including at least one voltage dropping circuit and at least one internal circuit both provided therein, said at least one voltage dropping circuit each operating to drop an external power supply voltage to generate a dropped voltage, and supplying said dropped voltage to a corresponding one of said at least one internal circuit, the at least one voltage dropping circuit each comprising:

a voltage divider that divides said external power supply voltage to obtain a divided voltage;

a comparator that compares said divided voltage with said dropped voltage, and generates a control voltage according to a result of the comparison;

a voltage generator including at least one transistor, for generating said dropped voltage in response to said control voltage; and a setting block that sets a ratio of said divided voltage to said dropped voltage, wherein said at least one transistor of said voltage generator having a chip size thereof determined to a value such that proper operation of a corresponding one of said at least one internal circuit is ensured under worst operating conditions thereof; and wherein said ratio of said divided voltage to said dropped voltage is determined to a value such that proper operation of said corresponding one of said at least one internal circuit is ensured under best operating conditions thereof, and at the same time said dropped voltage assumes a lowest value.

* * * * *